United States Patent [19]

Peterson et al.

[11] Patent Number: 4,841,709

[45] Date of Patent: Jun. 27, 1989

[54] SUSPENDED CEILING ASSEMBLY

[76] Inventors: Marvin Peterson, 6120 Oxboro Ave. North #123, Stillwater, Minn. 55082; Richard Petroske, 978 Seventeenth Ave. Southeast, Minneapolis, Minn. 55414

[21] Appl. No.: 25,636

[22] Filed: Mar. 13, 1987

[51] Int. Cl.[4] ..... E04B 5/52

[52] U.S. Cl. ..... 52/664; 52/488; 52/777; 52/780

[58] Field of Search ..... 52/664, 665, 484, 488, 52/777, 778, 779, 780, 666, 668

[56] References Cited

U.S. PATENT DOCUMENTS

| | | | |
|---|---|---|---|
| 3,003,055 | 10/1961 | Liberman | 52/668 |
| 3,241,280 | 3/1966 | Kreuger | 52/484 |
| 3,385,020 | 5/1968 | Olson | 52/780 |
| 3,470,666 | 10/1969 | Mod et al. | 52/780 |
| 4,281,498 | 8/1981 | Kern | 52/665 |
| 4,367,616 | 1/1983 | Pearson | 52/665 |
| 4,406,104 | 9/1983 | Beck et al. | 52/484 |
| 4,454,700 | 6/1984 | Kern | 52/665 |
| 4,525,971 | 7/1985 | Kern | 52/665 |

*Primary Examiner*—Michael Safavi

[57] ABSTRACT

A suspended ceiling constructed of wood having main beams and cross beams arranged to receive and support ceiling tiles. Each beam having horizontally projecting side extensions with the ends of the cross beams being grooved to frictionally fit on the side extensions of the main beam.

2 Claims, 1 Drawing Sheet

SUSPENDED CEILING ASSEMBLY

BACKGROUND OF THE INVENTION

This invention is directed to suspended ceilings and more particularly to suspended ceilings constructed of wood.

With the increase in home remodeling, industries supplying the tools and materials for the home remodeler have grown dramatically. In the past, most suspended ceilings utilized metal cross beams and required numerous supports to hold the ceiling in place. If the remodeler desires a wooden suspended ceiling, a carpenter must be hired to build each individual support system for the ceiling.

Examples of the present wood beam ceiling structures are the Kern patent, U.S. Pat. No. 4,454,700 issued June 19, 1984 and the Pearson patent, U.S. Pat. No. 4,367,616 issued Jan. 11, 1983.

The Kern patent requires assembly of the main beam which is then attached to similarly assembled cross beams. The cross beam is attached to the main beam using specifically designed metal clips. The entire structure is then attached to a wall piece by these same metal clips. The Pearson patent similarly utilizes a series of metal clips to attach the cross beams to the main beam and to attach the entire assembly to the wall pieces. Although aesthetically attractive, these ceilings are too complicated for many home remodelers. The use of metal brackets and braces also increase the weight of the assembly and necessitates the use of additional supports.

SUMMARY OF THE INVENTION

An object of this invention is to provide the home remodeler with an inexpensive suspended ceiling which is easy to assemble and install.

Another object of this invention is to construct a suspended ceiling assembly that is easily manufactured and required little modification to be installed in the home or office.

A feature of this suspended ceiling assembly is the use of single piece main beams and cross beams. The main beams may be constructed in various lengths and have ends cut at an angle to allow simple fastening of one main beam piece to the other. The sides of the main beam contain outward extensions which provide the support necessary for the cross beams and ceiling tiles. The ends of the cross beams are grooved to form an interlocking fit with the side extensions of the main beam. This interlocking fit may be further strengthened by fastening wood blocks to the intersection of the cross beam with the main beam.

This beam assembly is then attached to a series of wall mounted supports. The wall supports consist of a vertical support member and an upper horizontal member. The horizontal member extends outwardly from the wall to provide a support base for the beam assembly. The main beam extends to fit flush with the wall and rests on the top of the vertical member. The horizontal members are grooved to interlock with the side extensions. Wood blocks may also be used to provide additional support for the suspended ceiling.

DETAILED DESCRIPTION OF THE PREFERRED EMBODIMENT

Figure 1:
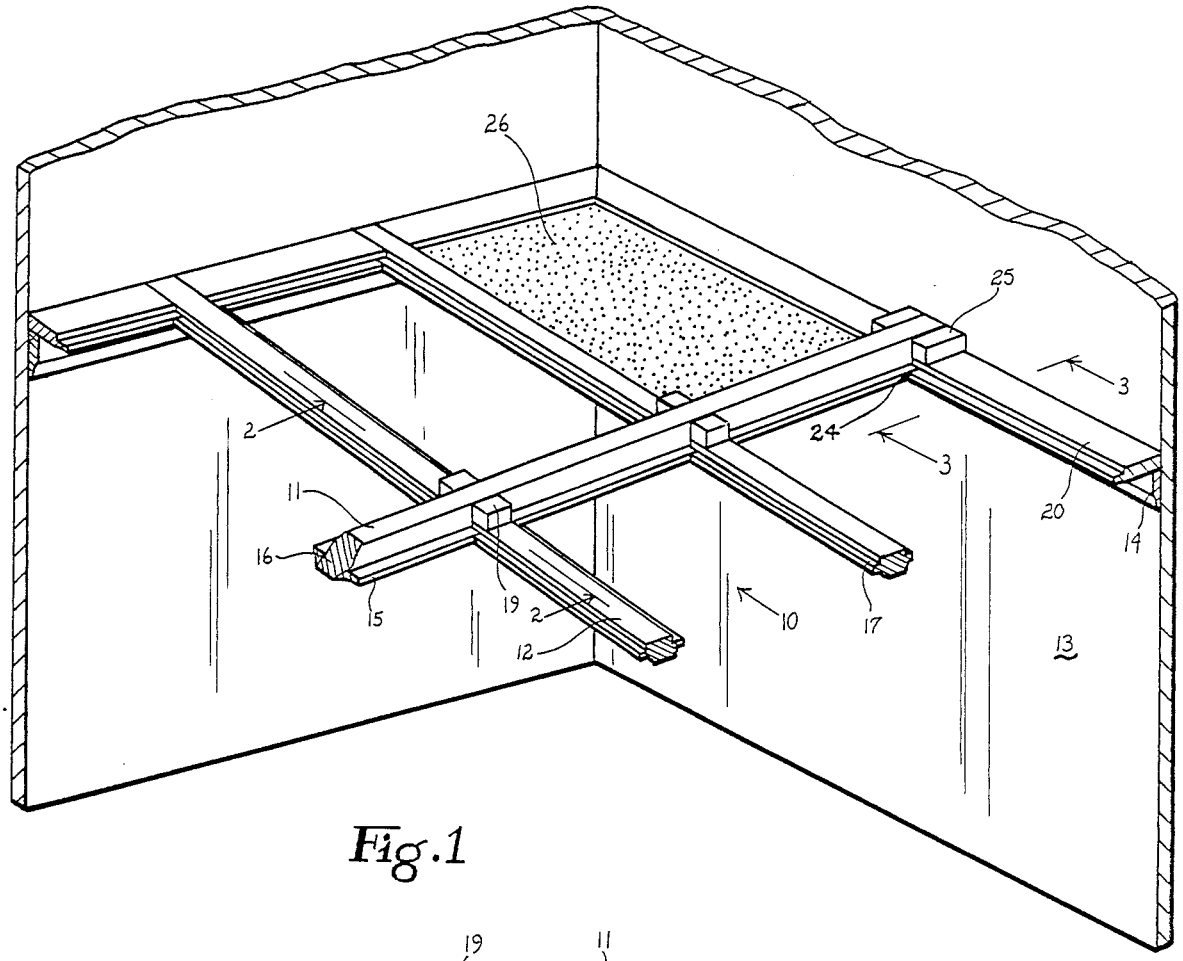
FIG. 1 is an elevation view of the suspended ceiling assembly.

One form of this invention is illustrated by the drawings and is described herein. The suspended ceiling is constructed primarily of wood and is described generally as 10. The suspended ceiling 10 includes a main beam 11 and cross beams 12. The beam assembly is supported against the wall 13 by vertical wall supports 14 which are fastened to the wall 13 along the entire perimeter of the room.

The main beam 11 is generally rectangular when seen in cross section. The lower section of the main beam 11 has horizontally projecting extensions 15 which extend approximately $\frac{1}{4}$ inch from the main section. The top of the horizontal extension 15 is flat and serves to support the cross beams 12 and ceiling tiles 26. The lower surface of the horizontal extensions 15 angle inwardly towards the main section of the beam 11 and provide and aesthetically pleasing surface. The ends 16 of the mean beam are cut at 45 degree angles to provide easy mating of the pieces. These main beam ends 16 may be fastened together using any commonly available fastening means, such as glue, nails or screws.

The cross beams 12 are constructed of wood and contain horizontally projecting side extensions 17 of the same dimension as those present on the main beam 11 and provide support for the ceiling tiles 26. The ends 18 of the cross beam 12 are grooved to create an interlocking fit with the corresponding horizontal extensions 15 of the main beam 11. The top of the cross beam 12 may be fastened to a wood block 19 which is then fastened to the top section of the main beam 11. The addition of these wood blocks 19 provides added stability to the suspended ceiling assembly 10.

Figure 2:
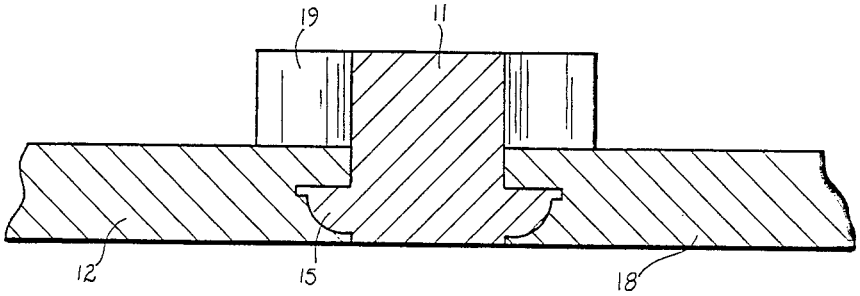
FIG. 2 is an enlarged section view taken along lines 2—2 of FIG. 1.
Figure 3:
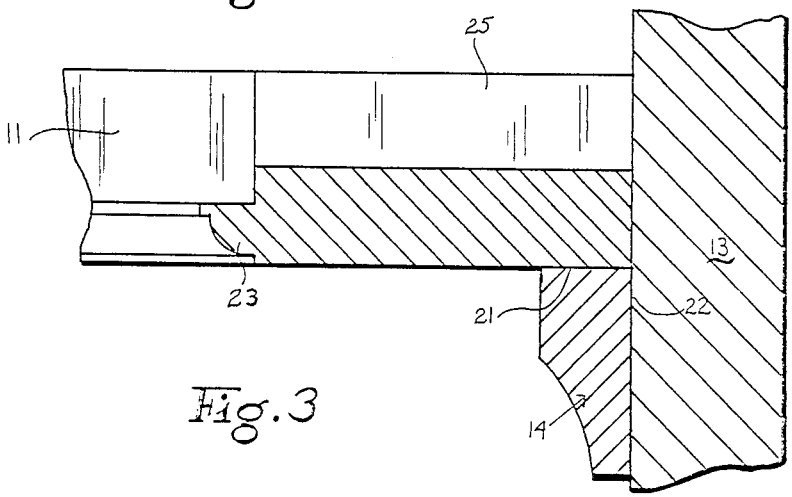
FIG. 3 is an enlarged section view taken along line 3—3 of FIG. 1.

A vertical wall support 14 is attached to the wall and provides the primary means of support for the entire suspended ceiling 10. Horizontal wall members 20 are attached to the flat top surface 21 of the vertical wall support 14. One side 22 of these horizontal wall members 20 is flat and fits flush with the wall 13. The other side 23 of the horizontal wall member 20 extends horizontally in the same configuration as the projecting horizontal extensions 15 of the main beam 11 and the side extensions 17 of the cross beams 12 to provide support for the ceiling tiles 26. The ends 24 of the horizontal wall member 20 are grooved to frictionally surround the horizontal extensions 15 of the main beam 11 near the end of the main beam 11 which is adjacent to the wall 13, in the same manner as is shown in FIG. 2. As illustrated in FIG. 1, the ends of the cross beams 12 and the end of the main beam 11 which is adjacent to wall 13, are nearly flush with the wall 13 and the respective extensions, 15 and 17, of the cross beams 12 and the main beam 11, frictionally fit within the grooved ends 24 of the horizontal wall members 20. As shown in FIG. 1, elongated wood blocks 25 may be used to provide added support to the suspended ceiling assembly 10.

What is claimed is:

1. A suspended ceiling assembly for installation in homes or offices, comprising:

a. a plurality of elongate main beams having upper and lower surfaces extending along the length dimension of said main beam, said lower surface of said main beam including horizontally extending extensions extending outwardly along the length dimension of said main beam;

b. a plurality of elongate cross beams having upper and lower surfaces extending along the length dimension of said cross beam, said lower surface of said cross beam including outwardly projecting side extensions extending outwardly in a generally horizontal orientation along the length dimension of said cross beam;

c. at least one grooved end on said cross beams, said grooved end providing an interlocking fit with said horizontal extensions of said main beams;

d. a wall support structure including a vertical support member extending around the periphery of the suspended ceiling assembly, said vertical support member being fastened to a wall surface;

e. a top support member fastened to said vertical support member, said to support member having a horizontally projecting side member and an opposite flat side surface positioned against the wall surface;

f. said main beams having ends adjacent to the vertical support member and in interlocing engagement with the top support members;

g. a plurality of said cross beams having ends fastened to said wall support structure by interlocing engagement with said top support member, and wherein the cross beams, main beams and wall support structure are arranged to support ceiling tiles therein on their respective horizontal extensions and side members; and h. a support block fastened to the upper surfaces of said cross beams adjacent said main beams to reinforce the cross beam and main beam.

2. The suspended ceiling assembly of claim 1, wherein a further support block is fastened to the main beam and adjacent the top support member to overlap said main beam end and said top support member.

* * * * *